US010226933B2

(12) United States Patent
Ishihara

(10) Patent No.: US 10,226,933 B2
(45) Date of Patent: Mar. 12, 2019

(54) PRINTING APPARATUS WITH DETACHABLE PRINTHEAD

(71) Applicant: CANON KABUSHIKI KAISHA, Tokyo (JP)

(72) Inventor: Masaaki Ishihara, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/653,800

(22) Filed: Jul. 19, 2017

(65) Prior Publication Data

US 2018/0029373 A1 Feb. 1, 2018

(30) Foreign Application Priority Data

Jul. 29, 2016 (JP) ..... 2016-150555

(51) Int. Cl.

| | |
|---|---|
| ***B41J 2/175*** | (2006.01) |
| ***B41J 2/04*** | (2006.01) |
| ***B41J 2/14*** | (2006.01) |
| ***B41J 25/34*** | (2006.01) |
| ***B41J 29/02*** | (2006.01) |

(Continued)

(52) U.S. Cl.

CPC ..... *B41J 2/17523* (2013.01); *B41J 2/04* (2013.01); *B41J 2/14048* (2013.01); *B41J 2/1752* (2013.01); *B41J 2/17513* (2013.01); *B41J 2/17553* (2013.01); *B41J 25/34* (2013.01); *B41J 29/02* (2013.01); *B41J 29/13* (2013.01); *B41J 2/24* (2013.01)

(58) Field of Classification Search

CPC .... B41J 2/1752; B41J 2/1753; B41J 2/17513; B41J 2/17553; B41J 2/04; B41J 2/14084; B41J 25/34; B41J 25/308; B41J 29/02; B41J 29/13; B41J 23/14

See application file for complete search history.

(56) References Cited

U.S. PATENT DOCUMENTS

| | | | |
|---|---|---|---|
| 9,283,754 | B2 | 3/2016 | Iwakura |
| 2001/0035895 | A1 | 11/2001 | Miyazaki et al. |

(Continued)

FOREIGN PATENT DOCUMENTS

| | | | |
|---|---|---|---|
| EP | 1 777 074 | A1 | 4/2007 |
| JP | 2004-090343 | A | 3/2004 |
| JP | 2014-065223 | A | 4/2014 |

OTHER PUBLICATIONS

Extended European Search Report dated Jan. 3, 2018, in European Patent Application No. 17001165.4.

*Primary Examiner* — Juanita D Jackson
(74) *Attorney, Agent, or Firm* — Venable LLP

(57) ABSTRACT

In an embodiment of this invention, a carriage includes a first lever that is operated by an operator to attach or detach a printhead and rotates about a first rotating shaft. The carriage also includes a second lever that rotates about a second rotating shaft parallel to the first rotating shaft and, if the printhead is attached, contacts part of the printhead and presses the printhead in accordance with the rotation. The carriage further includes a spring having one end hung on an end portion of the second lever and the other end hung on part of the carriage. If the printhead is attached, the press force of the spring acts to press the printhead against the carriage in accordance with the rotation of the first lever. If the printhead is detached, no press force acts.

17 Claims, 13 Drawing Sheets

(51) Int. Cl.
*B41J 29/13* (2006.01)
*B41J 2/24* (2006.01)

(56) References Cited

U.S. PATENT DOCUMENTS

2002/0163566 A1 11/2002 Jang et al.
2006/0146110 A1* 7/2006 Tsuji ..... B41J 2/1752
347/108

* cited by examiner

PRINTING APPARATUS WITH DETACHABLE PRINTHEAD

BACKGROUND OF THE INVENTION

Field of the Invention

The present invention relates to a printing apparatus, and particularly to a printing apparatus that includes a carriage configured to detachably hold a printhead for discharging ink, and prints by discharging ink to a print medium from the printhead while reciprocally scanning the carriage.

Description of the Related Art

There is known serial printing, in which an image is printed by alternately repeating an operation of scanning a carriage, to which a printhead is mounted, in a scanning direction (main scanning direction) with respect to a print medium such as print paper and an operation of conveying the print medium by a predetermined pitch in a direction (sub-scanning direction) different from the main scanning direction. Printing apparatuses that adopt such serial printing widely use an arrangement in which a printhead is detachably attached to a carriage.

As disclosed in Japanese Patent Laid-Open Nos. 2014-65223 and 2004-90343, there is known, as a printhead attachment/detachment method, a method in which a user or maintenance operator operates a lever provided in a carriage when mounting a printhead. By operating the lever, a state in which a press member presses or does not press the printhead against the carriage is selectively determined.

When fixing the printhead, the printhead is abutted against a predetermined position of the carriage and positioned. When detaching the printhead, the abutted state is released by operating the lever in a direction opposite to that at the time of mounting the printhead, thereby facilitating detachment of the printhead from the carriage.

In the conventional arrangement described in Japanese Patent Laid-Open No. 2014-65223, however, the following problem arises.

In the arrangement disclosed in Japanese Patent Laid-Open No. 2014-65223, if there is no printhead, an idle spring abuts against the carriage main body and stops. To set the printhead in this state, it is necessary to lift the spring by operating the lever to retract the spring from the attachment trajectory of the printhead.

At this time, the operator operates the lever to perform an operation of pressing the spring back against the press direction of the spring via the lever. However, at a position where the spring presses the printhead, the spring unwantedly interferes with the attachment trajectory of the printhead. To cope with this, it is necessary to press the spring back to a position where it does not interfere with the trajectory from the state in which the printhead abuts against the carriage main body through a state in which the spring presses the printhead, and to lock the spring to keep it in the state. It is thus necessary to press the spring back by a force larger than the force of the spring for pressing the printhead, and a lever operation force unwantedly becomes large.

In addition, if the spring which has been locked in the retracted state is released by operating the lever after inserting or detaching the printhead, the spring force accumulated in the retracted state is released at once, and thus the lever or spring moves quickly. If the printhead has been inserted, the spring shifts to the press state. If the printhead has been detached, the spring abuts against the carriage main body and stops. At this time, the released large force may damage the carriage main body. As a countermeasure against this, for example, it is necessary to add a support member, use a cushioning medium to absorb an impact, or use a material which is difficult to destroy.

To do this, a space for the member is necessary in the printing apparatus, or a new cushioning medium or expensive material is used. This poses a problem that, for example, the apparatus size becomes large or the apparatus manufacturing cost increases.

If a spring that generates a large force is formed in a limited space, the degrees of freedom of the size and shape when designing the spring are low, and thus it is difficult to suppress a stress on the spring and to obtain a large safety factor against destruction or settling of the spring. If the spring is largely retracted against its press direction, a stress on the spring becomes large. Therefore, it is difficult to largely retract the spring to give a degree of freedom to the attachment trajectory of the printhead.

That is, implementation of an arrangement of fixing a printhead to a carriage in a limited space and ease of attachment of the printhead or ensuring of the reliability of a spring at low cost have a trade-off relationship, and it is difficult to achieve both of them. Consequently, if the reliability, operability, and cost reduction of the printing apparatus are emphasized, a space for ensuring the strength of a part and the attachment trajectory of the printhead increases the whole carriage in size, and it is thus difficult to downsize the apparatus main body including the moving trajectory of the printhead.

Furthermore, as disclosed in Japanese Patent Laid-Open No. 2004-90343, in the arrangement in which the spring is arranged on the lever, when locking the spring from the open state of the lever, the lever is largely rotated to move to a position where gravity biases the lever in an opening direction. In this method, it is necessary to ensure a space corresponding to the rotating trajectory of the lever or to largely retract a cover with which the space is covered. To do this, it is necessary to keep a large space for rotating the cover and holding the open state, resulting in an increase in size of the main body of the printing apparatus.

SUMMARY OF THE INVENTION

Accordingly, the present invention is conceived as a response to the above-described disadvantages of the conventional art.

For example, a printing apparatus according to this invention is capable of downsizing the overall apparatus and improving the operability.

According to one aspect of the present invention, there is provided a printing apparatus comprising: a carriage to which a printhead is detachably mounted; an operation member rotatably provided to the carriage and movable between a first position at which the printhead is attached to or detached from the carriage and a second position at which the printhead is fixed to the carriage; a fixing member, rotatably provided to the operation member, capable of fixing the printhead to the carriage; and a spring member hung between the carriage and the fixing member, wherein if the operation member is at the second position in a state in which the printhead is mounted to the carriage, the fixing member fixes the printhead by pulling the spring member to have a first length, and if the operation member is at the second position in a state in which the printhead is not mounted to the carriage, the fixing member pulls the spring member to have a second length shorter than the first length.

The invention is particularly advantageous since it is possible to downsize the overall printing apparatus and improve the operability.

Further features of the present invention will become apparent from the following description of exemplary embodiments (with reference to the attached drawings).

DESCRIPTION OF THE EMBODIMENTS

Figure 1A:
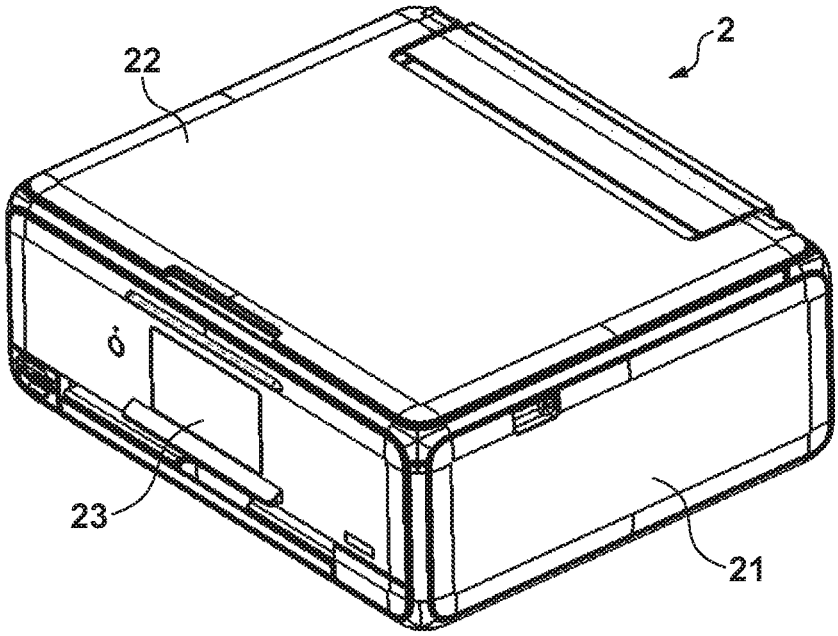
FIGS. 1A and 1B are perspective views each showing the arrangement of an inkjet printing apparatus according to an exemplary embodiment of the present invention.

Exemplary embodiments of the present invention will now be described in detail in accordance with the accompanying drawings. Note that the same reference numerals denote the same components throughout the drawings in the following description. Thus, the same reference numerals are used for already described components, and a repetitive description thereof will be omitted.

In this specification, the terms "print" and "printing" not only include the formation of significant information such as characters and graphics, but also broadly include the formation of images, figures, patterns, and the like on a print medium, or the processing of the medium, regardless of whether they are significant or insignificant and whether they are so visualized as to be visually perceivable by humans.

Also, the term "print medium (or sheet)" not only includes a paper sheet used in common printing apparatuses, but also broadly includes materials, such as cloth, a plastic film, a metal plate, glass, ceramics, wood, and leather, capable of accepting ink.

Furthermore, the term "ink" (to be also referred to as a "liquid" hereinafter) should be extensively interpreted similarly to the definition of "print" described above. That is, "ink" includes a liquid which, when applied onto a print medium, can form images, figures, patterns, and the like, can process the print medium, and can process ink. The process of ink includes, for example, solidifying or insolubilizing a coloring agent contained in ink applied to the print medium.

Further, a "print element" generically means an ink orifice or a liquid channel communicating with it, and an element for generating energy used to discharge ink, unless otherwise specified.

Figure 1B:
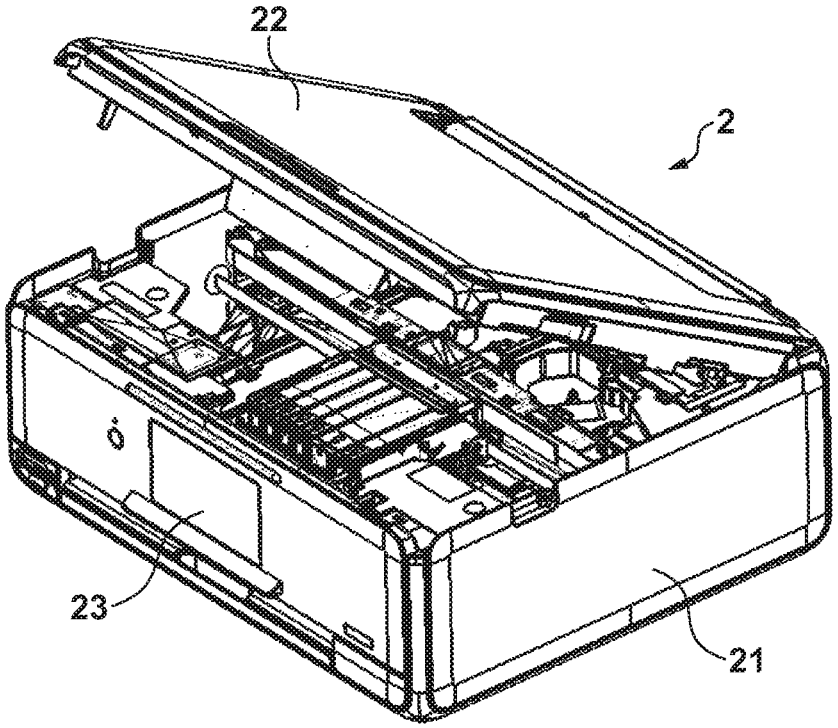

FIGS. 1A and 1B are perspective views each showing the arrangement of an inkjet printing apparatus (to be referred to as a printing apparatus hereinafter) according to an exemplary embodiment of the present invention. A printing apparatus 2 includes a printing unit (to be described later) that prints using an inkjet printhead (to be referred to as a printhead hereinafter) incorporated in an exterior 21, and a scanner unit 22 that reads an image by optically scanning an original. The printing apparatus 2 is provided with an operation unit 23 used by the user to perform an operation. Furthermore, the printing apparatus 2 includes a feeding unit (not shown) that feeds a print medium, a conveying unit (not shown) that conveys the print medium, and a maintenance unit (not shown) that is used to satisfactorily maintain the discharge state of the printhead.

FIG. 1A is a perspective view showing a state in which the scanner unit 22 of the printing apparatus 2 is closed. FIG. 1B is a perspective view showing a state in which the scanner unit 22 is opened.

The scanner unit 22 of the printing apparatus 2 is rotatably supported by the exterior 21 of the printing apparatus. When exchanging an ink tank or printhead, the scanner unit 22 is opened, as shown in FIG. 1B.

At the time of a printing operation, the operation unit 23 is opened to the front side to ensure a print medium discharge port on the front side (operation unit side) of the printing apparatus 2. Furthermore, at the time of the printing operation, the print medium supplied by the feeding unit is conveyed to the conveying unit, printed by the printhead provided in a carriage (to be described later) that reciprocally scans in a predetermined direction (the scanning direction of the carriage), and discharged to the front side of the printing apparatus 2.

Figure 2A:
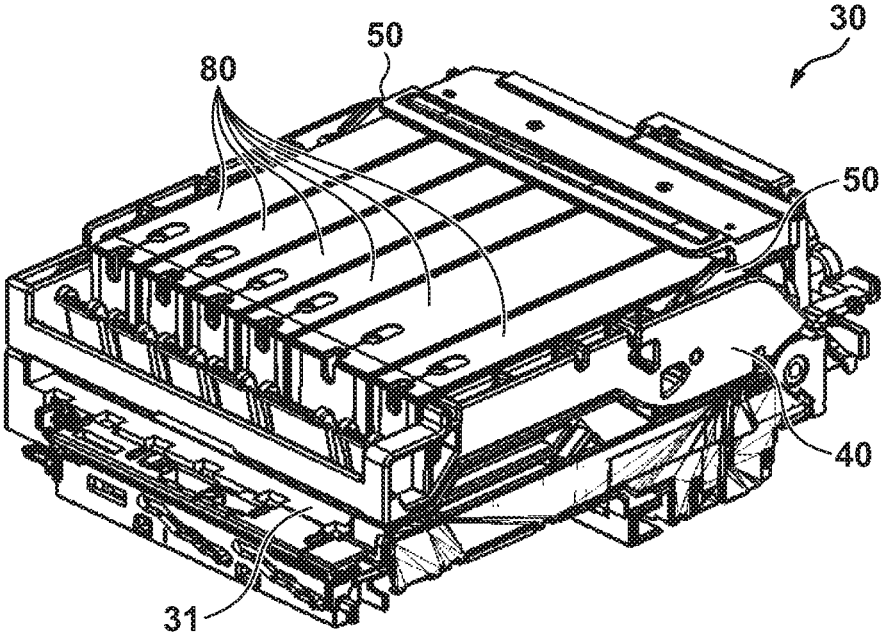
FIGS. 2A and 2B are perspective views each schematically showing the structure of a carriage in a state in which a printhead and ink tanks are attached.
Figure 2B:
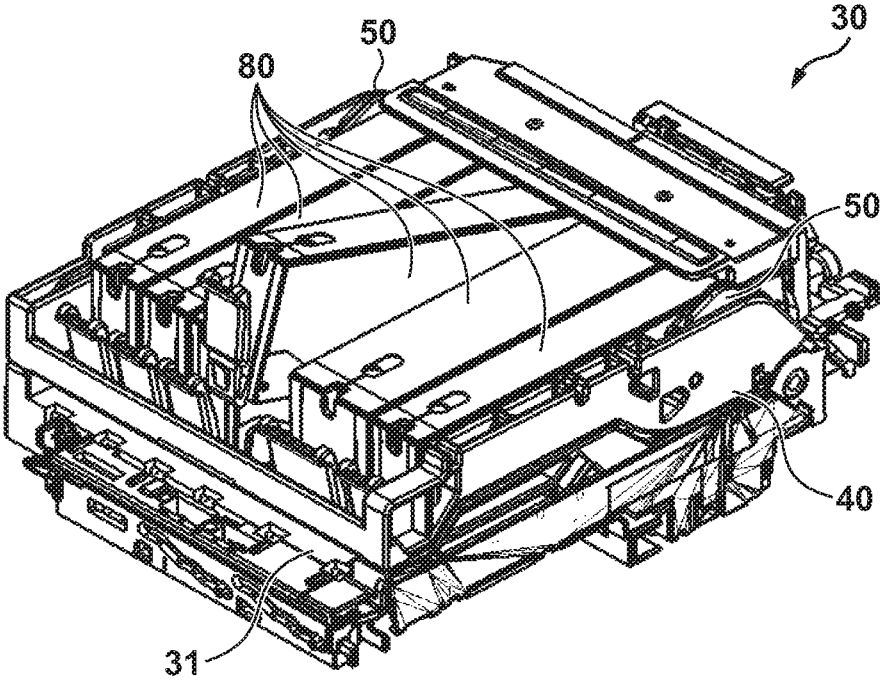

FIGS. 2A and 2B are perspective views schematically showing the structure of the carriage in a state in which the printhead and ink tanks are attached.

As shown in FIGS. 2A and 2B, a printing unit 30 is formed by including a carriage 31, a main lever 40, and sub levers 50. Each ink tank 80 is inserted from the front side of the printing apparatus 2 in a state in which the printhead (to be described later) is attached to the printing unit 30, and the front end of the ink tank 80 is caught in the printhead. When the engaging portion of the ink tank 80 is pressed down, the latch shape (not shown) of the ink tank 80 and the counter shape (not shown) of the carriage 31 engage with each other, and thus the ink tank 80 is fixed to the printing unit 30. In addition, when the engaging portion of the ink tank 80 is pressed down to release the latch of the engaging portion, and the ink tank 80 is moved to a position above the printing apparatus 2, the ink tank 80 is detached from the printing unit 30.

FIG. 2A shows a state in which six ink tanks are all attached to the carriage 31. FIG. 2B shows a state in which one of the ink tanks is detached from the carriage 31.

Figure 3A:
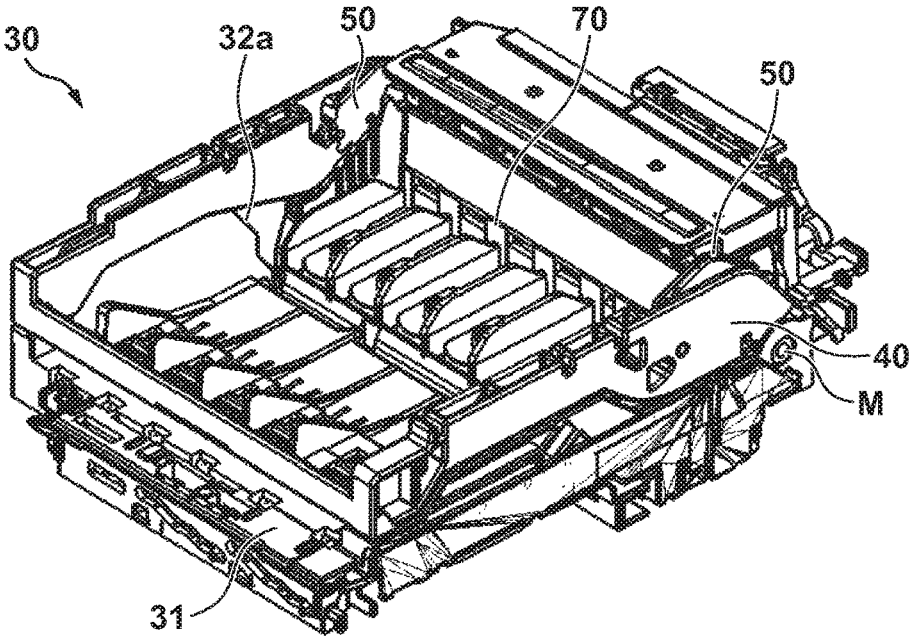
FIGS. 3A and 3B are perspective views, respectively, schematically showing the close and open states of a main lever while the printhead is inserted into the carriage.
Figure 3B:
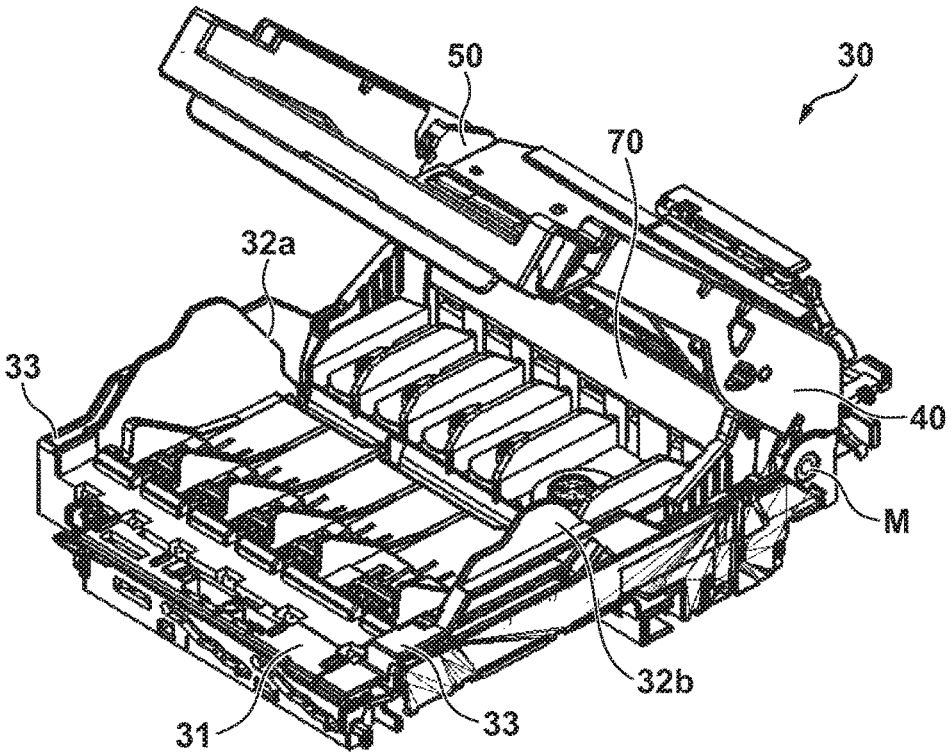

FIGS. 3A and 3B are perspective views of the printing unit showing a case in which the main lever is operated to attach the printhead to the carriage.

FIG. 3A shows a state in which a printhead 70 is attached and the main lever 40 is closed. FIG. 3B shows a state in which the printhead 70 is attached and the main lever 40 is opened. The position of the main lever 40 in the state in which the main lever 40 is opened will be referred to as the first position hereinafter (FIG. 3B), and the position of the main lever 40 in the state in which the main lever 40 is closed will be referred to as the second position hereinafter (FIG. 3A). Therefore, the main lever 40 can rotate between the first and second positions. Furthermore, as shown in FIGS. 3A and 3B, head guide portions 32*a* and 32*b* are bilaterally symmetrically provided in the carriage 31, and guide the printhead 70 to be attached. The main lever 40 rotates about rotating shafts M, and abuts against main lever contact surfaces 33 provided in the carriage 31 when set in the close state.

In either case, an image is formed by discharging ink to the conveyed print medium (not shown) such as print paper (print sheet) while the carriage 31 formed by attaching the ink tanks 80 and the printhead 70 to the printing unit 30 shown in FIGS. 2A to 3B reciprocally scans in the scanning direction in the printing apparatus 2.

Note that each ink tank 80 is a tank storing ink to be supplied to the printhead 70, and is attached/detached to/from the printing unit 30 in the state in which the printhead 70 is attached to the printing unit 30, as shown in FIGS. 3A and 3B.

The carriage 31 is guided and supported to reciprocally scan in a direction (main scanning direction) crossing (generally, orthogonal to) the conveying direction (sub-scanning direction) of the print medium.

Figure 4A:
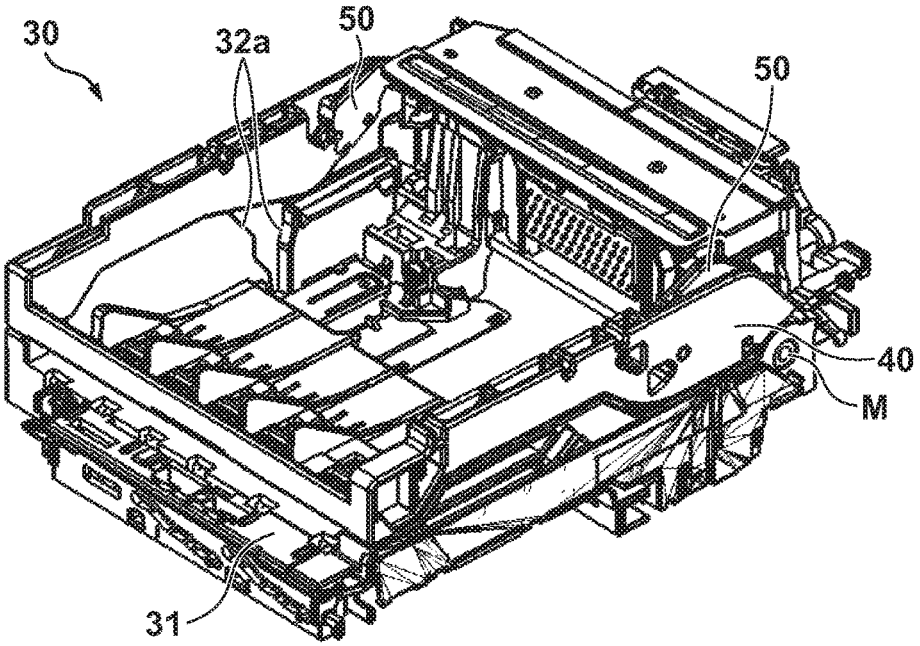
FIGS. 4A and 4B are perspective views, respectively, schematically showing the close and open states of the main lever without inserting the printhead into the carriage.
Figure 4B:
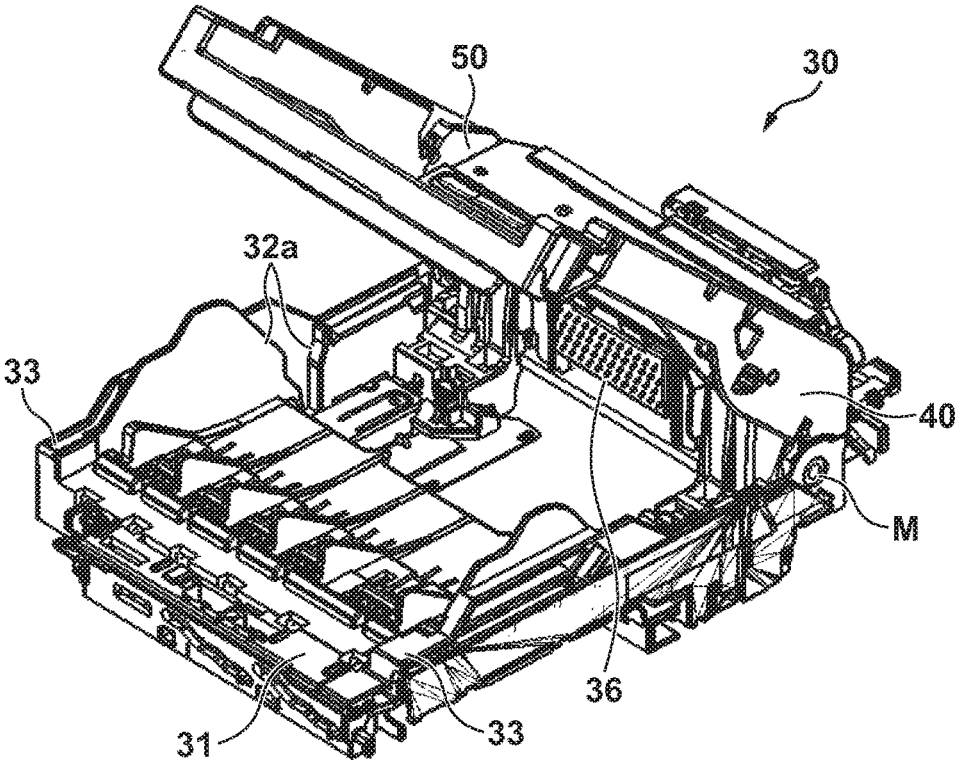

FIGS. 4A and 4B are perspective views, respectively, schematically showing the close and open states of the main lever without inserting the printhead into the carriage. FIG. 4A shows the close state of the main lever 40, and FIG. 4B shows the open state of the main lever 40. Specifically, as shown in FIG. 4B, the carriage 31 is attached with a connector 36 that press-contacts the electrode pad (not shown) of the printhead 70 when the printhead 70 is attached.

The carriage 31 of the printing unit 30 will be described with reference to the accompanying drawings. Press-fixing of the printhead 70 to the carriage 31 and electric connection between the printhead 70 and the carriage 31 will now be described.

Figure 5A:
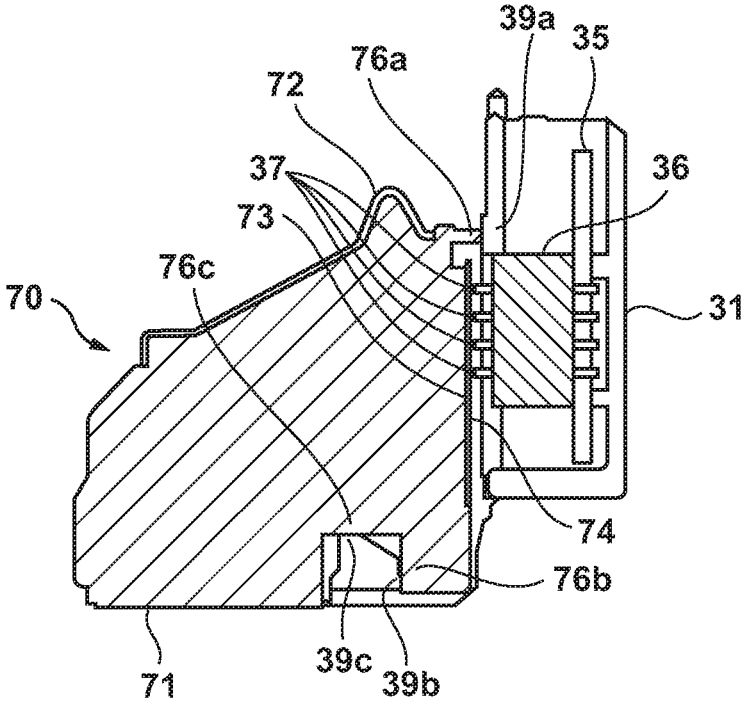
FIGS. 5A and 5B are a sectional view showing a connection portion between the carriage, the printhead and a press-contact connector and a perspective view schematically showing an electric board including the press-contact connector.
Figure 5B:
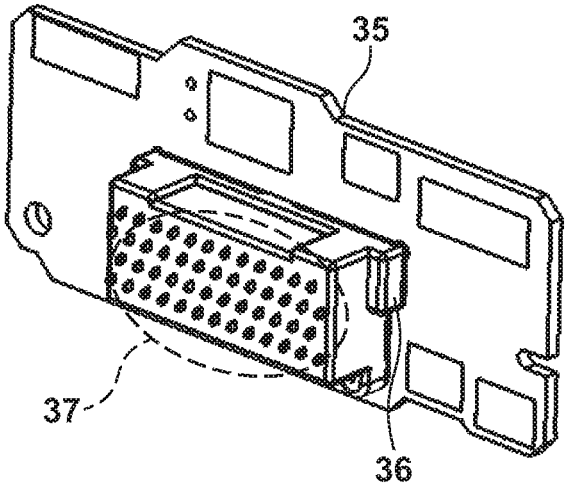

FIGS. 5A and 5B are a sectional view showing the connection portion between the carriage, the printhead, and the press-contact connector and a perspective view schematically showing an electrical board including the press-contact connector.

As shown in FIG. 5A, the printhead 70 is detachably attached to the printhead attachment position of the carriage 31. In the printhead 70, an ink discharge unit 71 that discharges ink to print an image is provided at a position facing the print medium.

The carriage 31 is driven via a timing belt (not shown) by a motor (not shown) attached to a chassis unit (not shown). The timing belt is given a predetermined tension and looped by an idle pulley (not shown) disposed on the opposite side of the motor. The timing belt is connected to the carriage 31, and a code strip (not shown) for detecting the position of the carriage 31 is provided in parallel to the timing belt. For example, 150 to 300 marks are formed per inch in the code strip. An encoder sensor (not shown) for reading the code strip (not shown) is mounted to the carriage 31.

The printhead 70 adopts the inkjet method, and prints an image based on image information transmitted from a host apparatus (not shown) or the like by discharging ink, to the print paper, from the ink discharge unit 71 forming a discharge surface on which a plurality of orifices are arrayed. It is necessary to provide, between the ink discharge unit 71 of the printhead 70 and the print surface of the print medium, a predetermined distance (gap) (for example, about 0.5 mm to 5.0 mm) to cause ink droplets to fly.

Figure 6:
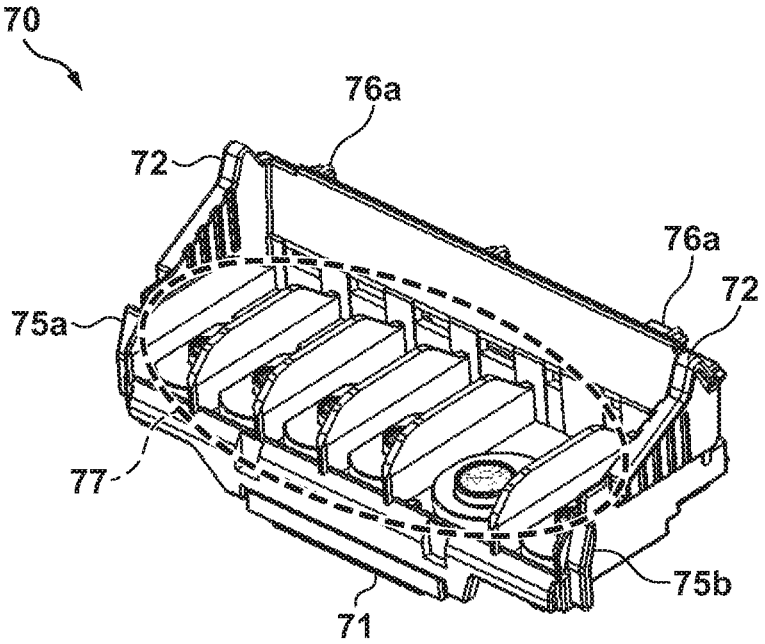
FIG. 6 is a perspective view schematically showing the arrangement of the printhead.

FIG. 6 is a perspective view schematically showing the arrangement of the printhead.

As shown in FIG. 6, the printhead 70 is formed into a box shape in which two outer surfaces of an approximately rectangular parallelepiped shape are open, and provided with the ink discharge unit 71 for discharging liquid on a lower surface side. An ink tank attachment portion 77 is formed in an upper portion of the printhead 70. When the printhead 70 is inserted into the printing unit 30, convex-shaped head guide portions 75*a* and 75*b* that are provided on the left and right sides of the head side surface are guided by the head guide portions 32*a* and 32*b* bilaterally symmetrically provided in the carriage 31. When the head guide portions 75*a* and 75*b* are guided, the printhead 70 is smoothly inserted into the carriage 31.

An overview of press fixing at the time of attaching the guides and the printhead when inserting the printhead 70 into the printing unit 30 will be described.

After inserting the printhead 70 into the printing unit 30, the main lever 40 and the sub levers 50 are closed from the state shown in FIG. 3B to the state shown in FIG. 3A. Accordingly, the printhead 70 is pressed by the sub levers 50, and carriage abutting surfaces 76*a*, 76*b*, and 76*c* of the printhead 70 are abutted against head abutting surfaces 39*a*, 39*b*, and 39*c*, and are press-fixed.

The electric connection between the carriage 31 and the press-fixed printhead 70 will be described next.

As shown in FIGS. 5A and 5B, a carriage board 35 is attached with the connector 36 on the head attachment surface side. Press-contact pins 37 made of metal are provided to penetrate the connector 36. Each press-contact pin 37 is soldered to the carriage board 35 on the opposite side of the head attachment surface (a surface that press-contacts a contact surface 74 of a head board 73 of the printhead 70). In the state in which the printhead 70 is attached to the printing unit 30, the distal end of each press-contact pin 37 press-contacts the contact surface 74 of the head board 73. This implements the electric connection between the main body side of the printing apparatus and the printhead 70.

In this embodiment, the number of press-contact pins 37 is 30 to 60. When attaching the printhead 70 to the carriage 31, a press-contact load of several tens to several hundreds gf is applied per pin, and a press-contact load of 3 to 5 kgf in total is generated as repulsion between the printhead 70 and the connector 36.

The press-contact load of the press-contact pin 37 is exerted in a state in which the printhead 70 is abutted against the head abutting surfaces 39*a* to 39*c* of the carriage 31 and fixed. Therefore, separation from the abutting surfaces means that the press-contact pins 37 and the contact surface 74 are separated, which decreases a press-contact force.

A decrease in press-contact force increases a contact resistance at the contact point, and thus the electric connection becomes unstable. When fixing the printhead 70 to the carriage 31, it is necessary to press-fix the printhead 70 to the carriage 31 by pressing the printhead 70 by a force larger than the repulsion and pressing the carriage abutting surfaces 76*a* to 76*c* against the head abutting surfaces 39*a* to 39*c*. To do this, it is necessary to press sub lever contact surfaces 72 of the printhead 70 by a sufficient press force.

A detailed arrangement for press-fixing the printhead 70 to the carriage 31 will be described.

Figure 7A:
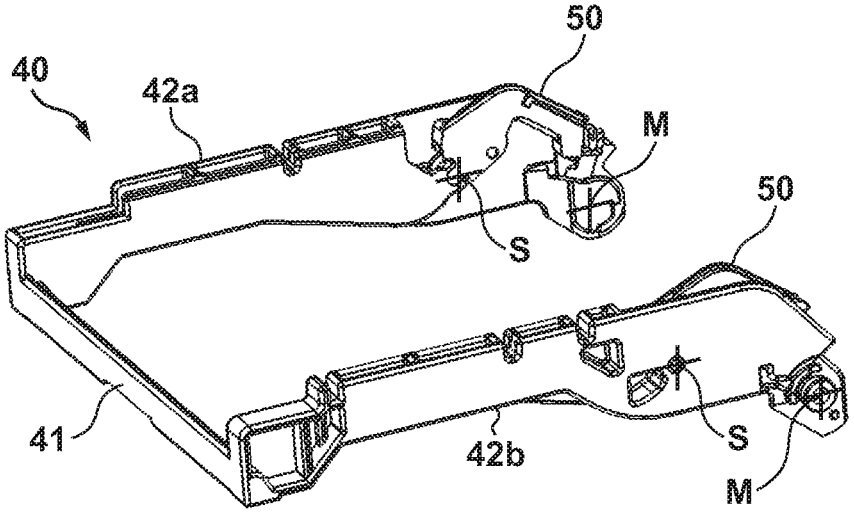
FIGS. 7A and 7B are perspective views, respectively, schematically showing a state in which the main lever and sub levers are combined and the structure of the main lever.
Figure 7B:
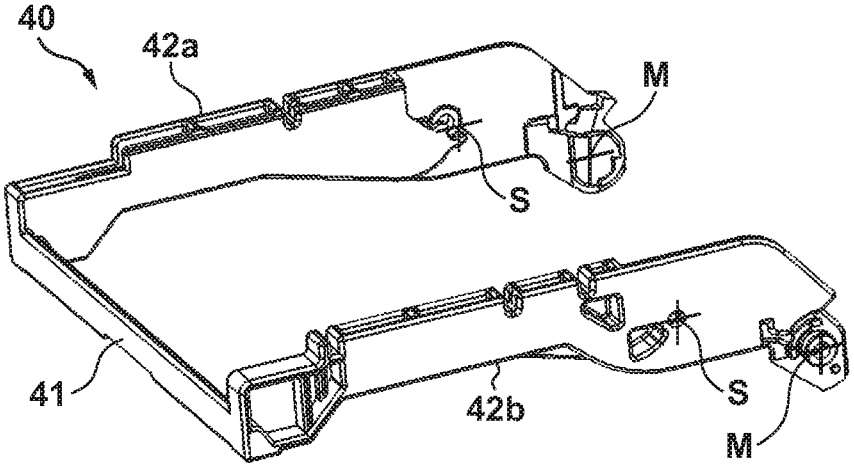

FIGS. 7A and 7B are perspective views, respectively, schematically showing a state in which the main lever and the sub levers are combined and the structure of the main lever. FIG. 7A shows a state in which the main lever 40 and the sub levers 50 are combined. FIG. 7B shows the detailed structure of the main lever 40.

As is apparent from FIGS. 3A to 4B, the main lever 40 has a U shape, and includes an operation portion 41 operated by the operator by applying a force, and two arm portions 42*a* and 42*b* respectively connected to two ends of the operation portion 41.

As shown in FIGS. 3A to 4B described above, the main lever 40 is rotatably supported by the carriage 31 to be rotatable about the rotating shafts M. Furthermore, as shown in FIGS. 7A and 7B, the operation portion 41 that functions as a portion applied with a force by the user to rotate the main lever 40 is provided in the central portion of the main lever 40.

As shown in FIG. 7A, the sub levers 50 are, respectively, bilaterally symmetrically arranged in the left and right arm portions 42*a* and 42*b* of the main lever 40, and each supported by the main lever 40 to be rotatable about a rotating shaft S.

Figure 8A:
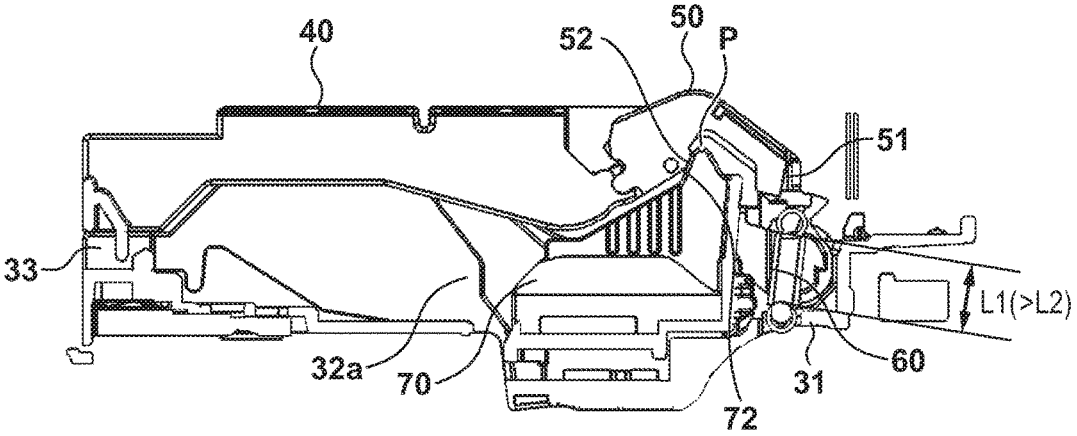
FIGS. 8A and 8B are sectional views of the carriage in the close and open states of the main lever.
Figure 8B:
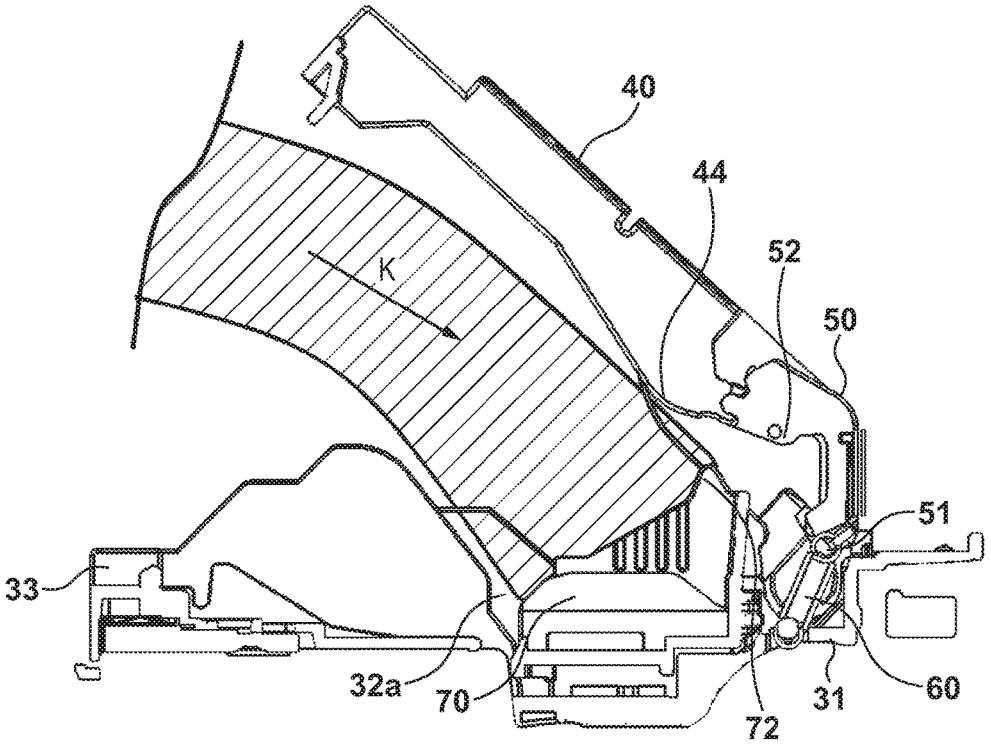

FIGS. 8A and 8B are sectional views of the carriage in the close and open states of the main lever. FIG. 8A shows a state in which the main lever 40 is closed (the main lever 40 is located at the second position). FIG. 8B shows a state in which the main lever 40 is opened (the main lever 40 is located at the first position).

As shown in FIGS. 8A and 8B, a press spring 60 for generating a force to press the printhead 70 against the carriage 31 is hung on a hook portion 51 provided in each sub lever 50. The press spring 60 is formed by a pulling spring, and has one end hung on the sub lever 50 and the other end hung on the carriage 31. Since the sub levers 50 are rotatably supported by the main lever 40, and the press springs 60 are hung on the sub levers 50, the sub levers 50 are biased to rotate clockwise about the rotating shafts S by the forces of the press springs 60.

In the state in which the main lever 40 is opened, as shown in FIGS. 3B, 4B, and 8B, the main lever 40 and the sub levers 50 retract from a trajectory K when inserting the printhead 70 into the carriage 31, as shown in FIG. 8B. In addition, a portion 44 of the main lever 40 has a guide shape when attaching the printhead 70, and guides the printhead 70 to be smoothly inserted into the carriage 31 together with the head guide portions 32*a* and 32*b* of the carriage 31.

Figure 9A:
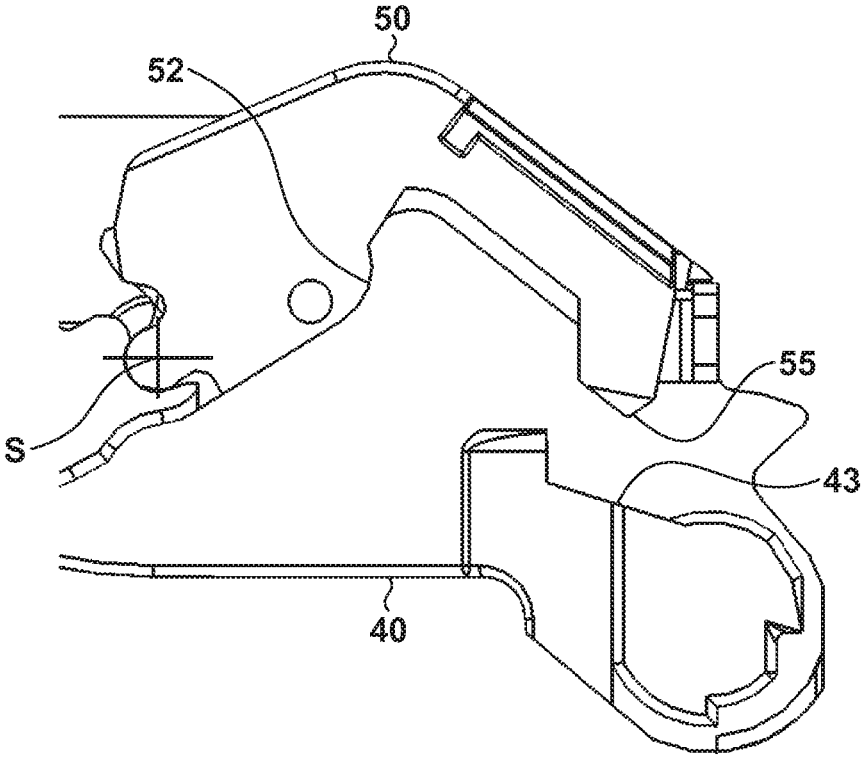
FIGS. 9A and 9B are schematic views each showing the engaging state between the main lever and each sub lever.
Figure 9B:
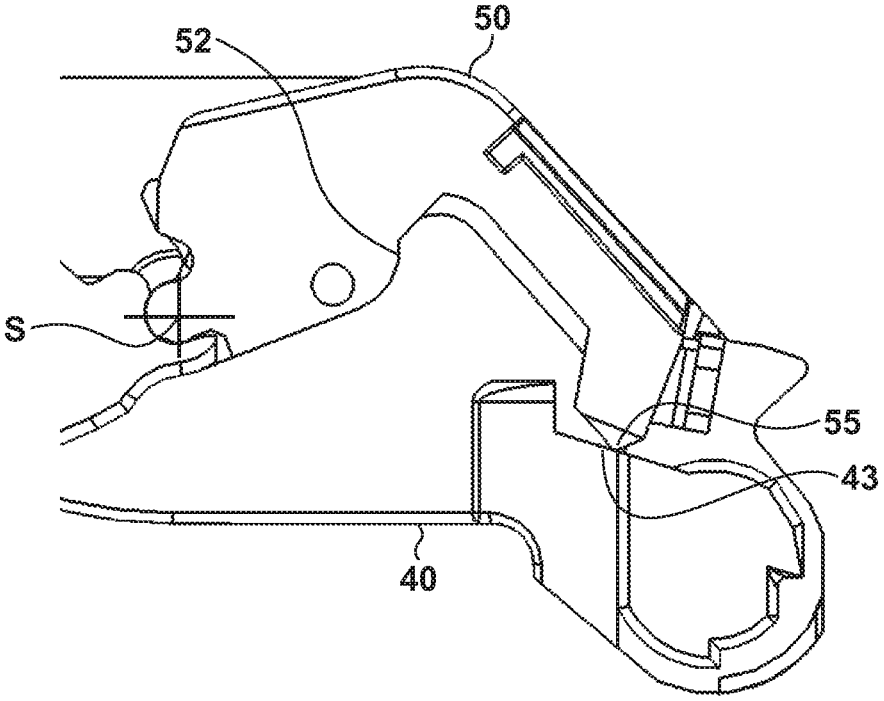

FIGS. 9A and 9B are enlarged perspective views each schematically showing the detailed structure of each sub lever.

As shown in FIGS. 9A and 9B, a sub lever contact surface 43 for restricting the clockwise rotating range of the sub lever 50 is provided in the main lever 40. Thus, as shown in FIG. 9B, the sub lever 50 biased by the press spring 60 relatively stops when a main lever contact surface 55 as part of the sub lever 50 abuts against the sub lever contact surface 43.

Figure 10A:
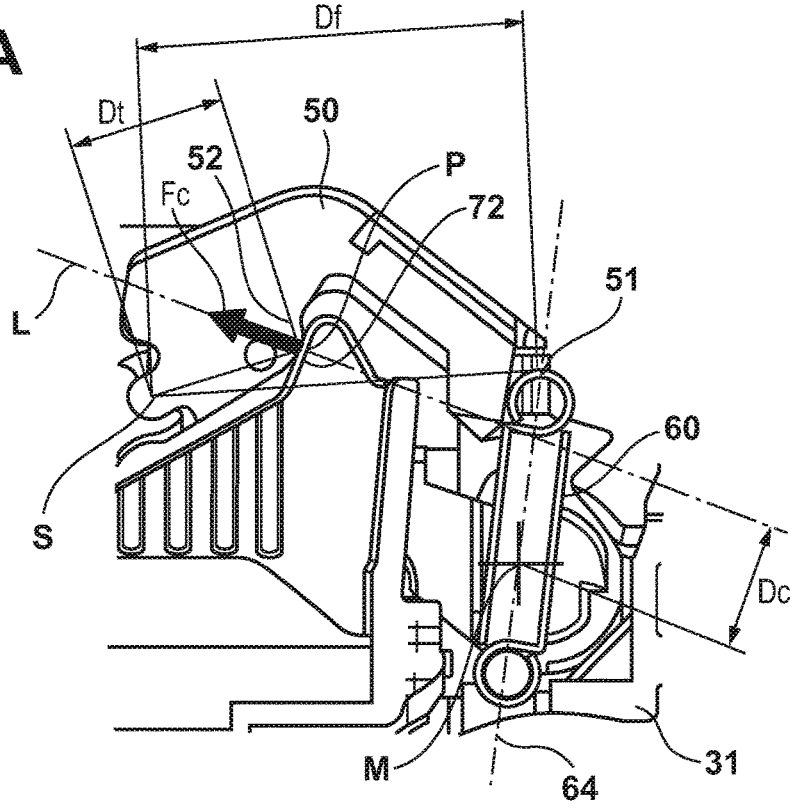
FIGS. 10A and 10B are sectional views respectively showing the peripheral portion of a sub lever and a press spring when the main lever is closed and opened by inserting the printhead.
Figure 10B:
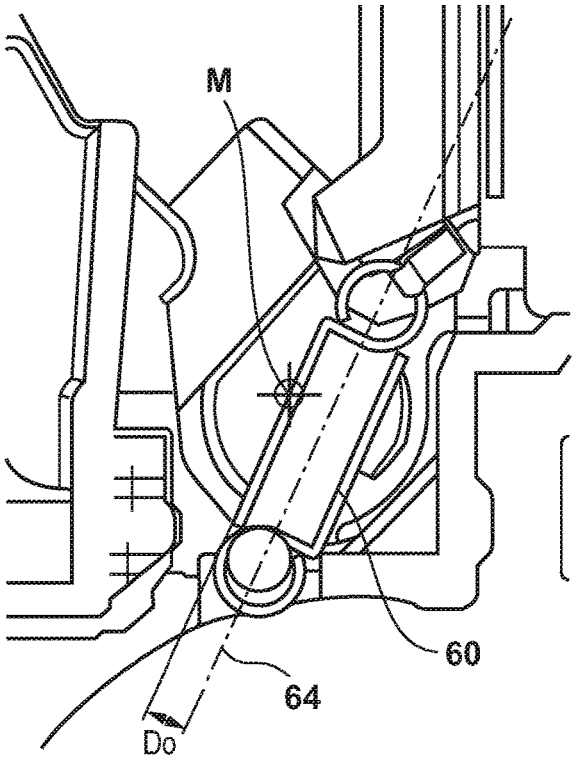

FIGS. 10A and 10B are views for explaining the action of each press spring together with the detailed structure of each sub lever. FIG. 10A shows the overall structure of each sub lever 50. FIG. 10B is an enlarged view of the peripheral portion of each press spring 60.

In the state shown in FIGS. 8B and 10B, the main lever 40 and the sub levers 50 that are pressed by the press springs 60 and relatively stop can rotate integrally, and are pulled by the press springs 60 in a direction of a one-dot dashed line 64 by the press springs 60 and biased. As shown in FIG. 10B, a spring force applied to the hook portion 51 of each sub lever 50 passes through a position that is apart from the rotating shaft M by a length Do without crossing the rotating shaft M. The length Do is set within a range in which the forces of the press springs 60 act as forces for rotation in a direction in which the sub levers 50 and the main lever 40 are opened integrally. Upon receiving the forces, the main lever 40 and the sub levers 50 are integrally biased clockwise in FIGS. 8B and 10B, and stop by abutting against a main lever stopper (not shown) provided in the carriage 31.

At this time, a force necessary to hold the main lever 40 is larger than a force which closes the main lever 40 and the two sub levers 50 by their self weights. If the main lever 40 and the sub levers 50 are members made of plastic material, a force of about several tens gf is obtained by converting the self weights into a force in the operation portion 41.

If, in the state in which the main lever 40 is opened, the operator rotates the main lever 40 in the closing direction by operating the operation portion 41 of the main lever 40, the sub levers 50 move about the rotating shafts M along with the rotation of the main lever 40 about the rotating shafts M. When the main lever 40 is closed completely, it contacts the printhead 70 to generate a press force for pressing the printhead 70 against the carriage 31 and press-fixing the printhead 70.

An arrangement of pressing the printhead 70 when the main lever 40 is closed will be described below.

In the state shown in FIGS. 8A and 10A, the sub levers 50 rotatably supported by the main lever 40 are in a state in which head contact portions 52 of the sub levers 50 contact the sub lever contact surfaces 72 of the printhead 70. That is, the forces of the press springs 60 hung on the hook portions 51 at the ends of the sub levers press the printhead 70, and the printhead 70 is abutted against the carriage 31 and fixed to it.

As shown in FIG. 10A, a normal line L to the sub lever contact surface 72 of the printhead 70 at a point P where the head contact portion 52 of each sub lever 50 contacts the sub lever contact surface 72 passes through a position that is apart from the rotating shaft M of the main lever 40 by a distance Dc without crossing the rotating shaft M. The distance Dc is set within a range in which a reaction force Fc of the force of each sub lever 50 for pressing the printhead 70 acts as a force for rotating the main lever 40 in the closing direction. Upon receiving the force for rotation in the closing direction, the main lever 40 is fixed by this reaction force by abutting against the main lever contact surfaces 33 provided in the carriage 31, as shown in FIG. 8A.

As described above, the repulsion of the press-contact pins 37 of the connector 36 acts between the carriage 31 and the printhead 70. Therefore, even if an external disturbance acts, for example, even if the repulsion is overcome and the carriage 31 and the printhead 70 tend to be separated by part tolerance or acceleration at the time of scanning of the carriage in the scanning direction during a printing operation, it is necessary to abut the printhead 70 against the carriage 31 stably and fix the printhead 70. To do this, necessary press-contact forces between the sub levers 50 and the printhead 70 depend on the arrangement but at least a force of about 6 to 10 kgf in total is required. Thus, an operation force of about 1 to 2 kgf is necessary in the operation portion 41.

In the state shown in FIG. 10A, a flux line expressed by the one-dot dashed line 64 of the press spring 60 almost passes through the rotating shaft M of the main lever 40. In this state, the forces of the press springs 60 never contribute to a force for rotating the main lever 40, and a force for rotating the main lever 40 is obtained from only the reaction forces of the forces of the press springs 60 for pressing the printhead 70 via the sub levers 50. Furthermore, in the state in which there is no printhead 70, there are no reaction forces, and thus the forces of the springs never contribute to the rotation of the main lever about the shafts M.

In addition, as shown in FIG. 10A, a distance Dt between the rotating shaft S of each sub lever 50 and its head contact portion 52 and a distance Df between the rotating shaft S and the hook portion 51 that engages with one end of the press spring 60 have a relationship given by:

$$Df=Dt\times n(n>1)$$

At this time, when N represents the force of the press spring 60 in the clockwise rotating direction, that is given to the sub lever 50, a force exerted in the head contact portion 52 of the sub lever is given by N×n (n>1), and a force larger than the spring force of the press spring 60 can be exerted in the head contact portion 52.

To attach the printhead 70, it is necessary to press-fix the printhead 70 by pressing the printhead 70 against the carriage 31 by a large force, as described above. However, the press force exerted by the sub lever 50 for the printhead 70 can be n times the force exerted by the press spring, as described above. Therefore, the press spring need only exert a force that is 1/n of the necessary force, and it is possible to accordingly suppress the size of the necessary spring to form an arrangement so as to prevent settling of the press spring. As a result, it is possible to reduce the necessary space.

Lastly, the behavior of the sub levers when the operator moves the main lever 40 from the open state to the close state will be described.

Figure 11A:
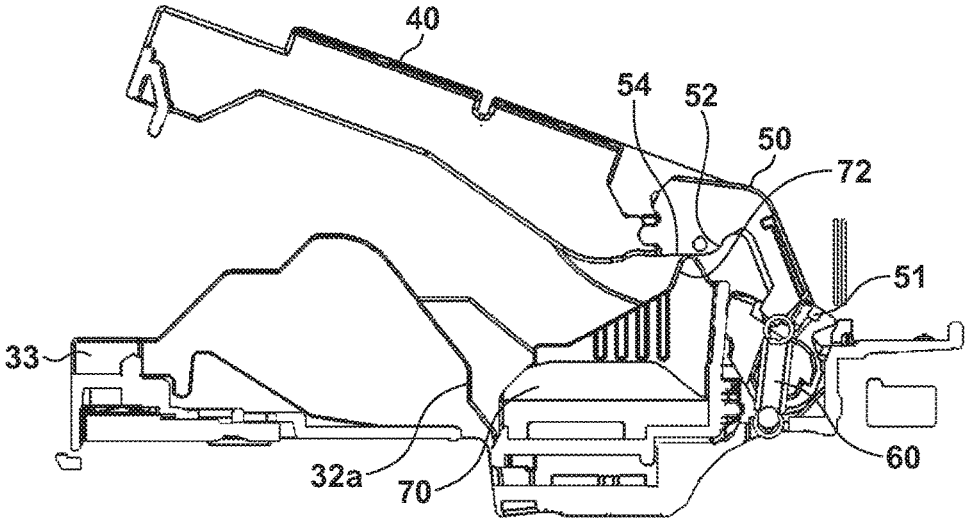
FIGS. 11A, 11B, and 11C are sectional views of the carriage showing a process from the open state of the main lever to its close state.
Figure 11B:
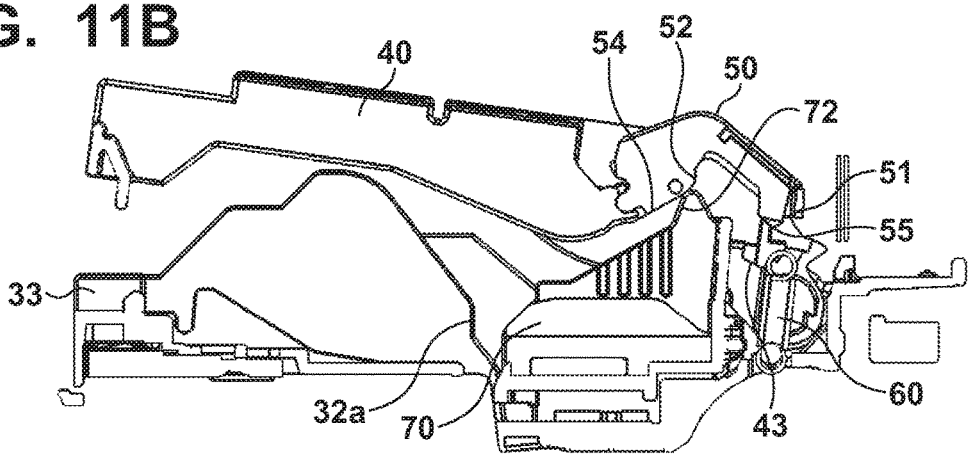
Figure 11C:
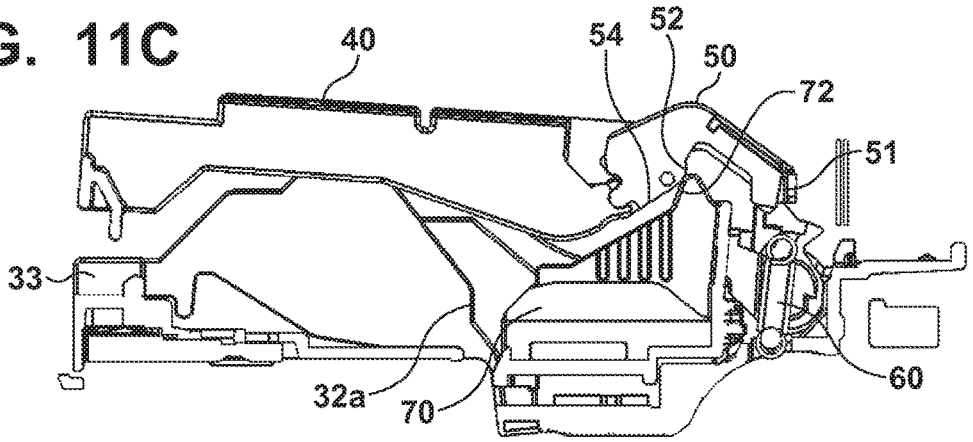

FIGS. 11A to 11C are sectional views of the carriage showing a process from the open state of the main lever to its close state.

As described above, FIG. 8B shows the state in which the main lever 40 is opened completely, and FIG. 8A shows the state in which the main lever is closed completely. Therefore, when the printhead 70 is placed on the carriage 31 and the main lever 40 is operated in the closing direction from the open state, the state changes like FIG. 8B→FIG. 11A→FIG. 11B→FIG. 11C→FIG. 8A. In the transition process, as described above, the main lever 40 and the sub levers 50 that are biased by the press springs 60 and abutted against the sub lever contact surfaces 43 of the main lever 40 integrally rotate and move about the rotating shafts M. There are the sub lever contact surfaces 72 of the printhead 70 on trajectories through which the sub levers 50 pass in this rotation movement.

Therefore, cam portions 54 of the sub levers 50 contact the sub lever contact surfaces 72 of the printhead 70, thereby hindering the movement of the main lever 40 (FIG. 11A). Furthermore, if the main lever 40 is operated in the closing direction, the main lever 40 rotates about the rotating shafts M, and the sub levers 50 are pressed counterclockwise by the sub lever contact surfaces 72, thereby separating the main lever contact surfaces 55 that contact the sub lever contact surfaces 43. Since the sub levers 50 are biased clockwise by the press springs 60, they move while sliding the cam portions 54 in contact with the sub lever contact surfaces 72 of the printhead 70 (FIG. 11B).

If the main lever 40 is further operated in the closing direction, the printhead 70 slides to the end portions of the cam portions 54 of the sub levers 50, and starts to slide with the head contact portions 52 continuously formed from the cam portions 54 in the sub levers 50 (FIG. 11C). The contact surfaces of the sub levers 50 with the printhead and the sub lever contact surfaces 72 of the printhead 70 slide in contact/press contact with each other until the main lever 40 is closed completely and stops by abutting against the main lever contact surfaces 33 of the carriage 31. As described above, if the main lever 40 is rotated from the open state (first position) to the close state (second position) in the state in which the printhead 70 is attached, large biasing forces always act on the press spring 60 to be pulled. As a result, as shown in FIG. 8A, the length of each press spring 60 becomes long (L1).

Note that if the main lever 40 is closed in the state in which no printhead 70 is attached, the sub levers 50 are biased clockwise by the forces of the press springs 60, and rotate integrally with the main lever while abutting against the sub lever contact surfaces 43 of the main lever 40, as described above. In this case, however, there is no printhead 70 and the sub levers never contact the printhead 70. Consequently, a state in which the sub levers 50 rotate clockwise and stop with respect to the main lever 40 while abutting against the sub lever contact surfaces 43 provided in the main lever 40 is continued until the main lever 40 finally abuts against the main lever contact surfaces 33. In this process, no press forces or reaction forces are generated between the sub levers 50 and the printhead 70, and thus no forces for rotating the main lever 40 in the closing direction act. Therefore, no large biasing forces act on the press springs 60, as compared with a case in which the printhead 70 is attached, and the length of each press spring 60 becomes slightly shorter (L2) (L2<L1).

To attach the printhead 70, no large force is necessary for the operator to operate the operation portion 41 of the main lever 40 in the opening direction, and a force acting on the main lever 40 does not change largely from the open state of the main lever 40 to its close state. Consequently, the operation portion 41 do not exhibit behavior with an impact when operating the operation portion 41, and thus the operator can complete the operation by a smaller force, thereby improving the operability.

Finally, the arrangement of the press springs 60 and sub levers 50 will be described.

Figure 12:
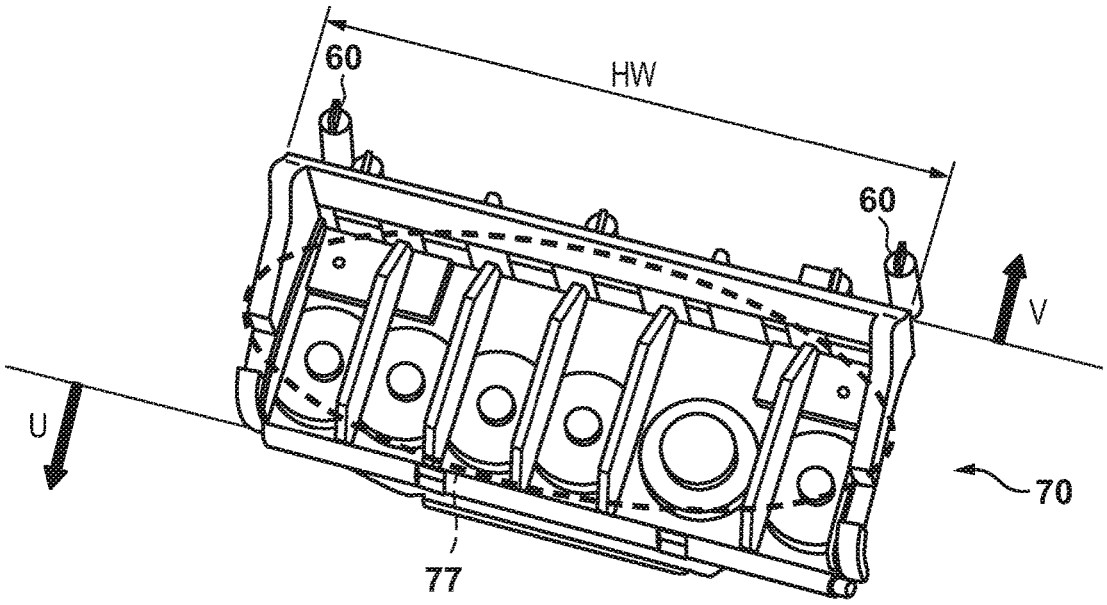
FIG. 12 is a perspective view schematically showing the positional relationship between the printhead and the press springs.

FIG. 12 is a perspective view schematically showing the positional relationship between the printhead and the press springs.

As shown in FIG. 12, the press springs 60 are located, within a width HW of the printhead 70 in the scanning direction in which the carriage 31 scans, on a side (a side of an arrow V) opposite to an operator side (a side of an arrow U) in a direction crossing the scanning direction with respect to the ink tank attachment portion 77 of the printhead 70. By arranging the press springs 60 within the width HW of the printhead 70 in the scanning direction in which the carriage 31 scans, the press springs 60 are arranged on the side away from the operator with respect to the ink tank attachment portion 77 while suppressing the size in the direction. This can form a mechanism of generating press forces without interfering with the attachment trajectory of the ink tanks 80.

Figure 13A:
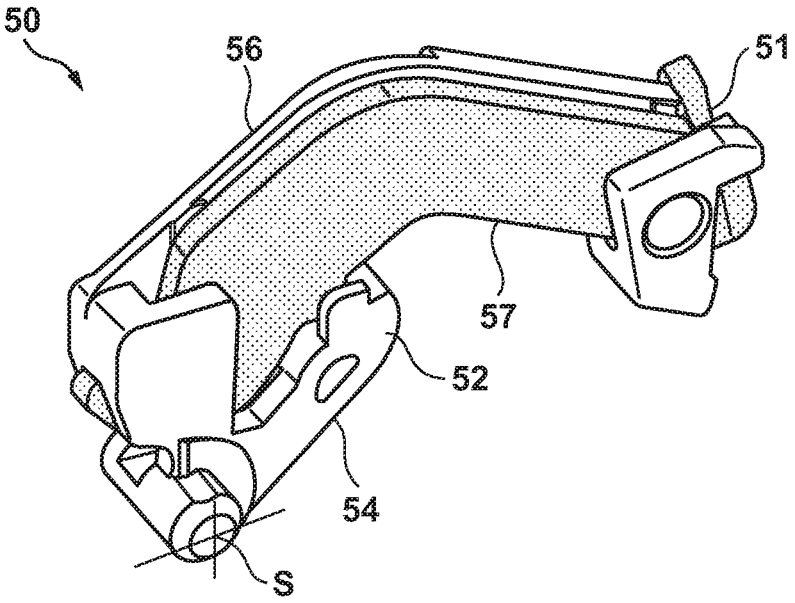
FIGS. 13A and 13B are perspective views each schematically showing the structure of the sub lever.
Figure 13B:
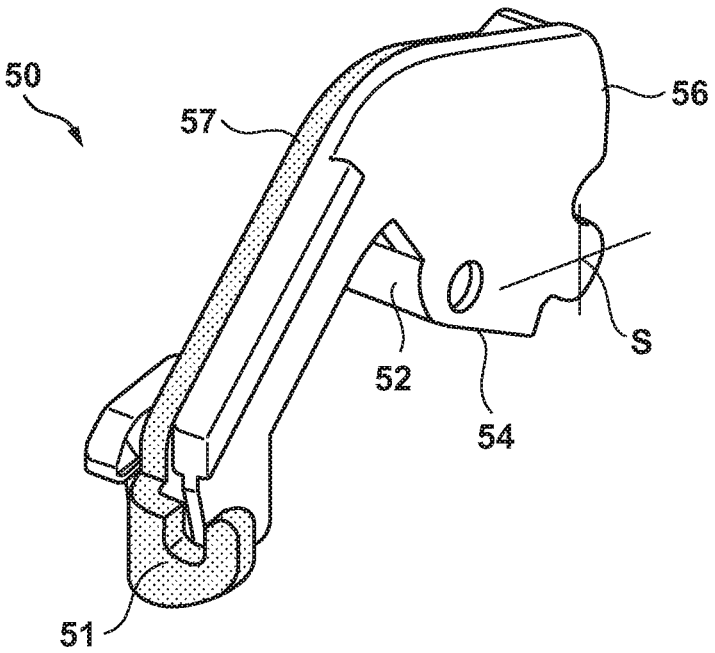

FIGS. 13A and 13B are perspective views each schematically showing the structure of each sub lever. FIG. 13A is a perspective view showing the sub lever 50 when viewed from the inside of the ink tank attachment portion 77. FIG. 13B is a perspective view showing the sub lever 50 when viewed from the outside of the ink tank attachment portion 77.

As shown in FIGS. 13A and 13B, the sub lever 50 includes a resin part 56 and a metal part 57. A shaft portion that engages with the main lever 40 and is rotatably supported, and the cam portion 54 and head contact portion 52 that slide with the printhead 70 are formed by the resin part 56. The hook portion 51 on which the press spring 60 is hung is formed by the metal part 57.

By forming the sub lever 50 in this way, a portion that receives the force of the press spring 60 is made of metal, and thus it is possible to suppress the size necessary to ensure the strength, as compared with a case in which the portion is made of resin. On the other hand, since a portion that slides with another part is made of resin, it is possible to suppress a sliding resistance between the other part and the sub lever on which a vertical reaction of several kgf acts, as compared with a case in which the portion is made of metal that readily generates a frictional force larger than that of resin. This eliminates the necessity of grease application or the like for smoothing and stabilizing the behavior of the sub lever, thereby eliminating the factor for an increase in cost that is necessary for grease application or the like.

With the above arrangement, when the main lever 40 is set in the open state, the open state is maintained by the forces of the press springs 60.

On the other hand, in the state in which the printhead 70 is inserted into the carriage 31 and the main lever 40 is closed, the press springs 60 apply press forces to the printhead 70 via the sub levers 50 rotatably supported by the main lever 40, thereby abutting the printhead 70 against the carriage 31 and fixing the printhead 70. In addition, the sub levers 50 bias, in a direction in which the main lever 40 is closed, the reaction forces of the press forces of the press springs 60 transmitted to the printhead 70. Thus, using only the press springs 60, the printhead 70 can be abutted against the carriage 31 and fixed and the close state of the main lever 40 can be held. At this time, the length of each press spring 60 becomes slightly longer (L1) since the press spring is pulled by the large biasing force.

In the state in which the main lever 40 is closed without attaching the printhead 70 to the carriage 31, no forces of the press springs 60 act, and thus the main lever 40 can be operated by a small force. At this time, the length of each press spring 60 becomes slightly shorter (L2) (L2<L1).

According to the above-described embodiment, holding of the open state of the main lever, holding of the close state of the main lever while the printhead is attached, improvement of the operability while no printhead is attached can be implemented without adding a lock mechanism or spring. When no printhead is attached, it is not necessary to resist a spring load or impact at the time of an operation. Thus, it is possible to suppress an increase in size along with addition of a support member.

A force acting in the rotating direction of the main lever in the state in which the main lever is closed exists or does not exist. Therefore, a force acting on the lever used to attach/detach the printhead is simple. Thus, for example, any unintentional operation caused by an increase/decrease in force for closing the main lever, occurrence of a force for opening the main lever in a state in which there is no force for closing the main lever, or the like does not occur.

It is possible to suppress the force of the press spring on each sub lever to 1/n with respect to the press force necessary to abut the printhead against the carriage and fix the printhead. Consequently, it is possible to reduce the space necessary to form the press springs, and reduce settling of the press springs.

Since the press springs can be provided at positions which do not interfere with the attachment trajectory of the printhead and ink tanks and do not require an additional space in the printhead in the scanning direction of the carriage, it is possible to suppress the size necessary to form the printing unit.

Furthermore, each sub lever is formed so that neither deformation nor destruction occurs when receiving the press force of the press spring. Thus, it is possible to implement the sub lever in a cost-saving form having satisfactory slidability with another part while ensuring sufficient strength.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-150555, filed Jul. 29, 2016, which is hereby incorporated by reference herein in its entirety.

What is claimed is:

1. A printing apparatus comprising:

a carriage to which a printhead is detachably mounted;

an operation member rotatably provided on the carriage and movable between a first position at which the printhead is attached to or detached from the carriage and a second position at which the printhead is fixed to the carriage;

a fixing member, rotatably provided on the operation member, capable of fixing the printhead to the carriage; and a spring member attached between the carriage and the fixing member, wherein when the operation member is at the second position in a state in which the printhead is mounted to the carriage, the fixing member presses the printhead by pulling the spring member to have a first length, and when the operation member is at the second position in a state in which the printhead is not mounted to the carriage, a length of the spring member becomes a second length shorter than the first length.

2. The apparatus according to claim 1, wherein when the operation member moves from the first position to the second position in the state in which the printhead is mounted to the carriage, the fixing member presses the printhead to the carriage by rotating in contact with the printhead to pull the spring member to have the first length, and when the operation member moves from the first position to the second position in the state in which the printhead is not mounted to the carriage, the length of the spring member becomes the second length.

3. The apparatus according to claim 1, wherein the fixing member is biased by the spring member by a first biasing force by setting the length of the spring member to the first length, and presses the printhead to the carriage, and the fixing member is biased by the spring member by a second biasing force smaller than the first biasing force by setting the length of the spring member to the second length.

4. The apparatus according to claim 1, wherein
the operation member has a U shape,
the operation member includes an operation portion operated by an operator, and two arm portions respectively connected to two ends of the operation portion,
each of the two arm portions includes a first rotating shaft at an end portion on a side opposite to a side connected to the operation portion,
the operation member is connected to the carriage via the first rotating shafts,
the fixing member comprises two fixing members, and
the two fixing members are combined, via second rotating shafts respectively provided near the first rotating shafts, with end portions on the sides of the two arm portions opposite to the sides connected to the operation portion.

5. The apparatus according to claim 4, wherein no press force of the spring member for pressing the printhead against the carriage acts at the first position, and the press force of the spring member acts at the second position.

6. The apparatus according to claim 5, wherein when the operation member is located at the first position, the spring member biases the fixing members to maintain the operation member at the first position around the first rotating shafts regardless of whether the printhead is attached.

7. The apparatus according to claim 5, wherein when the operation member is located at the second position in the state in which the printhead is attached to the carriage, parts of the fixing members contact the printhead, and the spring member biases the fixing members in a direction in which the printhead is pressed against the carriage.

8. The apparatus according to claim 5, wherein
when the operation member rotates to the first position, one end of each fixing member contacts part of the operation member and rotation of each fixing member stops, and
when the operation member rotates from the first position to the second position, one end of each fixing member is separated from the part of the operation member and each fixing member rotates together with the operation member.

9. The apparatus according to claim 4, wherein a distance Dt from the second rotating shaft to a position at which the fixing member contacts the printhead and a distance Df from the second rotating shaft to a position at which the spring member is attached to the fixing member have a relation of $Df=Dt\times n$ ($n>1$).

10. The apparatus according to claim 4, wherein a reaction of a press force of each spring member for pressing the printhead against the carriage, which is received by each fixing member, biases the operation member around the first rotating shaft in a direction of the press force.

11. The apparatus according to claim 4, further comprising plural spring members, wherein when the operation member is located at the second position where a press force of each spring member for pressing the printhead against the carriage acts, a flux line of each spring member crosses the first rotating shaft.

12. The apparatus according to claim 4, wherein
the operation member is operated by an operator to attach/detach the printhead, and
each fixing member rotates about the second rotating shaft parallel to the first rotating shaft in accordance with rotation of the operation member and, if the printhead is attached, contacts part of the printhead and presses the printhead in accordance with the rotation.

13. The apparatus according to claim 12, wherein when the printhead is attached to the carriage, the press force of the spring member acts to press the printhead against the carriage in accordance with the rotation of the operation member, and when the printhead is detached from the carriage, no press force acts.

14. The apparatus according to claim 4, wherein each fixing member includes a cam portion contacting part of the printhead in the state in which the printhead is attached to the carriage, rotates while the cam portion slides with the printhead in accordance with the rotation of the operation member, and presses the printhead by the cam portion.

15. The apparatus according to claim 1, wherein
the carriage includes abutting portions against which the printhead to be attached is abutted, and
when the operation member is located at the first position, a space for attaching the carriage by abutting the printhead against the abutting portions is ensured.

16. The apparatus according to claim 1, wherein
the fixing member is formed by combining a resin part and a metal part,
the resin part slides with the operation member and the printhead, and
the spring member is hung on the metal part.

17. The apparatus according to claim 1, wherein
the printhead comprises an inkjet printhead, and
the carriage further includes an attachment portion to which a detachable ink tank is attached.

* * * * *